US006782647B2

(12) United States Patent
Richards et al.

(10) Patent No.: US 6,782,647 B2
(45) **Date of Patent: *Aug. 31, 2004**

(54) MOUNTING FOR SHEET MATERIAL

(75) Inventors: James L. Richards, Boulder, CO (US); Marvin A. Smith, Incline Village, NV (US)

(73) Assignee: Epic Media Group LLC, Los Angeles, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/338,628

(22) Filed: Jan. 8, 2003

(65) Prior Publication Data

US 2003/0106249 A1 Jun. 12, 2003

Related U.S. Application Data

(63) Continuation of application No. 09/935,134, filed on Aug. 21, 2001, now Pat. No. 6,513,272, which is a continuation of application No. 09/337,100, filed on Jun. 21, 1999, now Pat. No. 6,276,082.

(51) Int. Cl.[7] ..... G09F 17/00

(52) U.S. Cl. ..... 40/603; 40/590; 160/328; 160/378

(58) Field of Search ..... 40/590, 603, 604; 160/327, 328, 378

(56) References Cited

U.S. PATENT DOCUMENTS

| | | | | |
|---|---|---|---|---|
| 3,373,464 A | | 3/1968 | Ausnit | 24/576 |
| 4,955,928 A | | 9/1990 | Tanner | 40/603 |
| 5,042,182 A | | 8/1991 | King | 40/603 |
| 5,058,299 A | | 10/1991 | Suzuki | 40/603 |
| 5,245,774 A | | 9/1993 | Huber | 40/603 |
| 5,301,447 A | | 4/1994 | Lotter et al. | 40/603 |
| 5,467,546 A | | 11/1995 | Kovalak, Jr. | 40/603 |
| 5,664,354 A | | 9/1997 | Daviau et al. | 40/603 |
| 5,685,099 A | | 11/1997 | Favata | 40/590 |
| 5,893,227 A | | 4/1999 | Johansson et al. | 40/603 |
| 6,041,535 A | | 3/2000 | Holloway et al. | 40/603 |
| 6,073,376 A | | 6/2000 | Verret | 40/603 |
| 6,164,364 A | | 12/2000 | Morris | 160/327 |
| 6,209,245 B1 | | 4/2001 | Wittenberg | 40/603 |
| 6,241,305 B1 | | 6/2001 | Troeger et al. | 296/102 |
| 6,250,002 B1 | | 6/2001 | Wittenberg | 40/603 |
| 6,257,306 B1 | | 7/2001 | Weldy | 160/327 |
| 6,276,082 B1 | * | 8/2001 | Richards et al. | 40/603 |
| 6,282,822 B1 | | 9/2001 | Rinzler et al. | 40/590 |
| 6,324,797 B1 | | 12/2001 | Fago et al. | 52/222 |
| 6,339,889 B1 | | 1/2002 | Griesemer et al. | 40/603 |
| 6,513,272 B2 | * | 2/2003 | Richards et al. | 40/603 |
| 6,564,488 B2 | * | 5/2003 | Wittenberg | 40/603 |
| 2003/0089012 A1 | * | 5/2003 | Smith | 40/603 |
| 2003/0140539 A1 | * | 7/2003 | Green et al. | 40/603 |

OTHER PUBLICATIONS

TransMedia Brochure, undated.

* cited by examiner

*Primary Examiner*—William L. Miller
(74) *Attorney, Agent, or Firm*—Fulbright & Jaworski L.L.P.

(57) ABSTRACT

A mounting for a sheet that has a bead about its periphery includes frame members forming a rectangle with each frame member including mutually parallel multiple engagement surfaces defined on ribs. An elongate retainer includes an elongate flange with an interlocking surface which can selectively interlock with any one of the engagement surfaces on the frame. The frame also has a frame rail having a rail surface that faces away from a retainer rail surface on a rail of the retainer. A tool including pinch rollers squeeze the rail surfaces toward one another to place the sheet material held by the retainer in tension while the interlocking surface is engaged with the appropriate engagement surface.

10 Claims, 5 Drawing Sheets

MOUNTING FOR SHEET MATERIAL

This is a continuation of U.S. patent application Ser. No. 09/935,134, filed Aug. 21, 2001, now U.S. Pat. No. 6,513,272, which is a continuation of U.S. patent application Ser. No. 09/337,100, filed Jun. 21, 1999, issuing as U.S. Pat. No. 6,276,082, on Aug. 21, 2001, the disclosures of which are incorporated herein by reference.

BACKGROUND OF THE INVENTION

Advertising and other information is often temporarily presented on large sheets which are placed on billboards, truck panels and the like. One form of such sheet material is tensioned vinyl sheet. Such sheet may be printed upon and surrounded by a more rigid plastic border which is RF (radio frequency) welded to the sheet. The border typically includes a large bead, circular in cross section, which operates as a tenon in association with a C-shaped mortise associated with a mounting frame.

Mounting frames may take on a plurality of configurations. Of value is the ability to tension the sheet and to maintain it in a tensioned and wrinkle-free state. Mechanisms have been used which first lock the sheet in place and then apply tension through off-center bolts and the like.

SUMMARY OF THE INVENTION

The present invention is directed to a mounting for a sheet having a tenon and mortise element about at least a portion of the periphery of the sheet. The mounting includes two or more elongate frame members which are parallel and displaced from one another. At least one of the elongate frame members includes an engagement surface facing away from the other elongate frame member. An elongate retainer is associated with each of the elongate frame members that has an engagement surface. The elongate retainer has an interlocking surface which can be positioned in interlocking engagement with an engagement surface. An elongate retainer tenon and mortise element on the elongate retainer engages the sheet tenon and mortise element to hold the sheet.

In a first separate aspect of the present invention, the elongate frame member that has an engagement surface includes a frame rail surface which also faces away from the other elongate frame member. A retainer rail surface on the retainer faces away from the frame rail surface. These rail surfaces allow tensioning of a sheet through compression toward one another.

In a second separate aspect of the present invention, at least one of the elongate frame members has mutually parallel multiple engagement surfaces. The interlocking surface can then be in interlocking engagement with any of the engagement surfaces. This allows accommodation of different sheet sizes.

In a third separate aspect of the present invention, the one or more engagement surfaces are each located on the side of an elongate rib. The one or more ribs extend outwardly from the frame member and are angled away from the opposed elongate frame member. The interlocking surface on the elongate retainer may also be placed on the side of an elongate flange to interlock with an engagement surface.

In a fourth separate aspect of the present invention, any of the foregoing separate aspects may further include a second set of elongate frame members such that the two sets form a rectangular frame for retaining a sheet on all four sides.

In a fifth separate aspect of the present invention, any of the foregoing separate aspects may further include each set of the elongate frame members being identical, with one or more engagement surfaces and corresponding identical elongate retainers with interlocking surfaces.

In a sixth separate aspect of the present invention, any of the foregoing separate aspects may be combined to complement the mounting for a sheet.

Accordingly, it is an object of the present invention to provide an improved sheet mounting. Other and further objects and advantages will appear hereinafter.

DETAILED DESCRIPTION OF THE PREFERRED EMBODIMENTS

Figure 1:
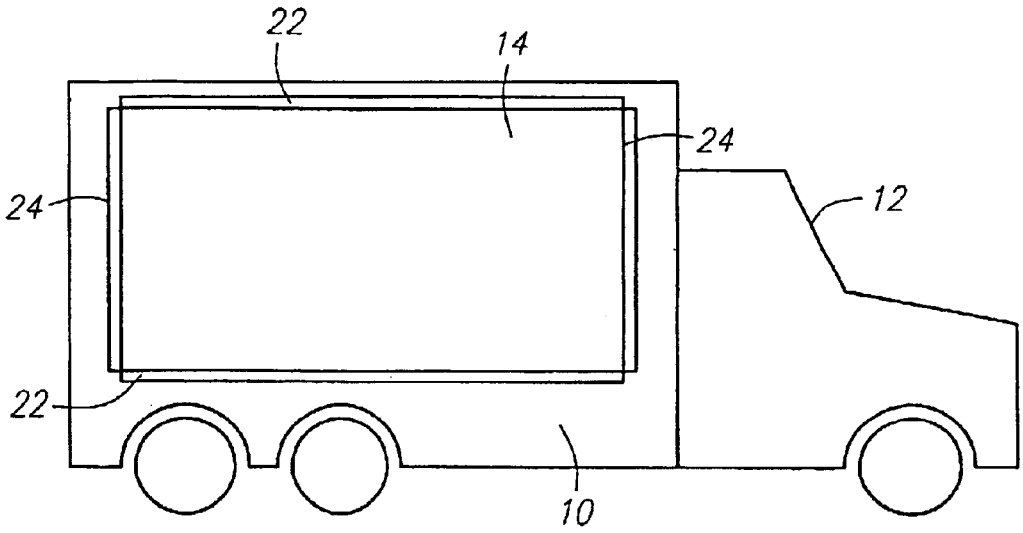
FIG. 1 is the side view of a truck having a mounting and a vinyl sheet mounted thereto.
Figure 5:
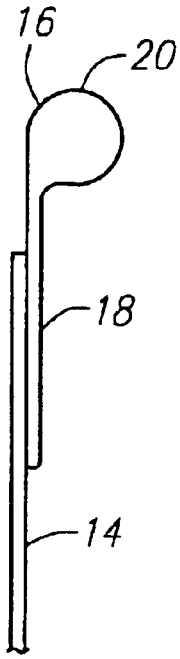
FIG. 5 is an end view of a tenon associated with a sheet by RF welding.

Turing in detail to the drawings, FIG. 1 illustrates a truck as one substrate upon which a mount can be fastened. The mounting system is affixed to the side panel 10 of the truck 12. A sheet 14 is mounted on the panel 10. The sheet 14 is contemplated to be vinyl which may be printed upon and tensioned when mounted. The sheet 14 may be finished with a peripheral boundary defined by a strip 16 as can best be seen in FIG. 5 which is formed with an attachment plate 18 and a bead 20 which is roughly circular in cross section and preferably offset relative to the attachment plate 18. This offset places the attachment plate 18 on a tangent to the bead 20. The bead 20 acts as a tenon in mounting the sheet as will be described below. The offset draws the sheet closer to the substrate. The attachment plate 18 is RF welded to the sheet material. Other bonding techniques may be equally applicable.

In FIG. 1 two sets of frame members are illustrated to define a rectangular mounting. The first set of elongate frame members 22 is horizontally disposed with the frame members 22 being mutually parallel and mutually displaced from one another. The second set of elongate frame members 24 are vertically disposed and also mutually parallel and displaced from one another. For convenience, the frame members 22 and 24 are all identical extrusions but for orientation and length. These frame members 22 and 24 are easily mounted to the side panel 10 of the truck 12 by common fasteners which may be self-tapping screws, bolts and nuts or the like. As the components are extrusions, the shape of the end views of each of the components reflects the full length of the structure.

The elongate frame members 22 and 24 include a base plate 26 with parallel elongate ribs 28 extending from one side thereof. The ribs 28 are at a 90° angle to the plane of the base plate 26 but could be equally rigid with other suitable shapes. An engagement surface 30 is located on the side of each rib 28 which is angled toward the base plate 26. These engagement surfaces 30 are shown to be with an undercut portion to further enhance interlocking. The elongate frame members 22 and 24 also include a frame rail 32 having a frame rail surface 34. The outer portion of the frame rail surface 34 is shown in this embodiment as angled at 90° from the plane of the base plate 26. The frame rail surface 34 faces roughly in the same general direction as the engagement surfaces 30.

The elongate frame members 22 and 24 are arranged in sets as noted above. The frame members 22 and 24 are each oriented such that the engagement surfaces 30 and the frame rail surface 34 of one elongate frame member 22, 24 face away from the other elongate frame member 22, 24 of the same set. Thus, the elongate frame members 22, 24 are arranged on the side panel 10 of the truck 12 such that the two horizontal frame member 22 are arranged with the frame rails 32 at the top on the upper elongate frame member 22 and at the bottom on the lower elongate frame member 22. The same frame rails 32 are placed outwardly on the vertical elongate frame members 24.

Figure 4:
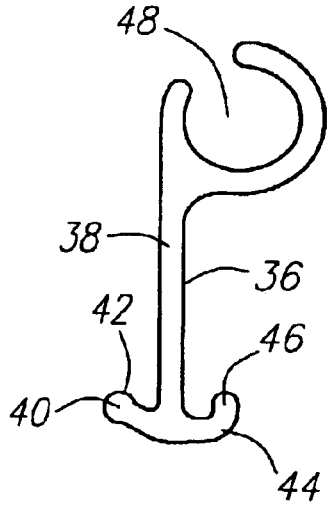
FIG. 4 is an end view of the elongate retainer.

The elongate retainer is illustrated in FIG. 4. This retainer 36 includes a base plate 38. An elongate flange 40 is located along one edge of the base plate 38 and extends at an angle of approximately 60° from the plane of the base plate 38. The elongate flange 40 includes an interlocking surface on one side of the elongate flange 40. The interlocking surface 42 is within the included angle between the elongate flange 40 and the plane of the base plate 38.

The elongate retainer 36 includes a retainer rail 44 which has a retainer rail surface 46 on one side thereof. The retainer rail surface 46 is also to one side of an approximately 90° angle made with the plane of the base plate 38 and includes a contour mating with the contour of the frame engagement surfaces 30.

Figure 2:
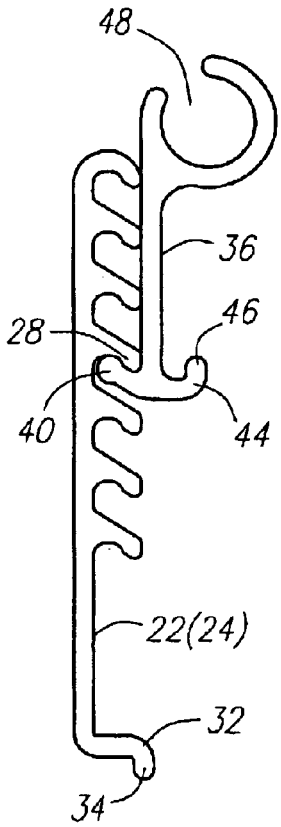
FIG. 2 is an end view of an elongate frame member assembled with an elongate retainer of a mounting.
Figure 3:
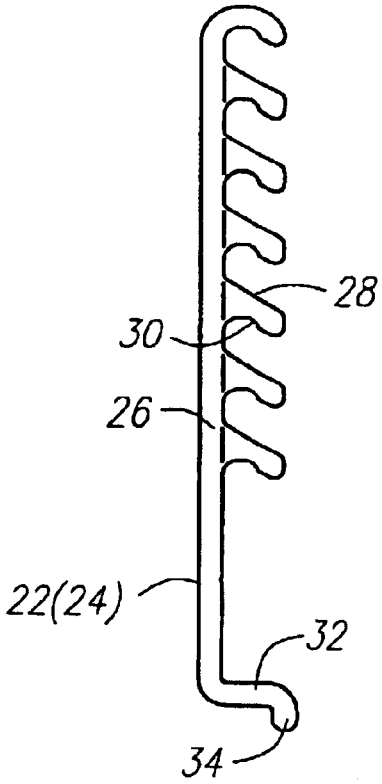
FIG. 3 is an end view of the elongate frame member.

In addition to the elongate flange 40 and the retainer rail 44, the elongate retainer 36 includes a channel of substantially circular cross section with an opening along its length to define a retainer mortise element 48. The mortise element 48 cooperates with the offset circular bead 20 forming a tenon element to capture the edge of the strip 16 attached to the sheet 14. The mortise element 48 is located at the opposite edge of the retainer base plate 38 from the elongate flange 40 and the retainer rail 44. FIG. 2 illustrates an association of the elongate frame members 22, 24 and the elongate retainer 36. The elongate flange 40 is shown extending between ribs 28 such that the engagement surface 30 and the interlocking surface 42 are positioned in interlocking engagement. This engagement is with the sheet 14 in tension and extending away from the elongate retainer 36 form the mortise element 48. Naturally, the elongate flange 40 may be placed in any one of the slots defined between the ribs 28 to assure appropriate tension in the sheet 14.

Figure 6:
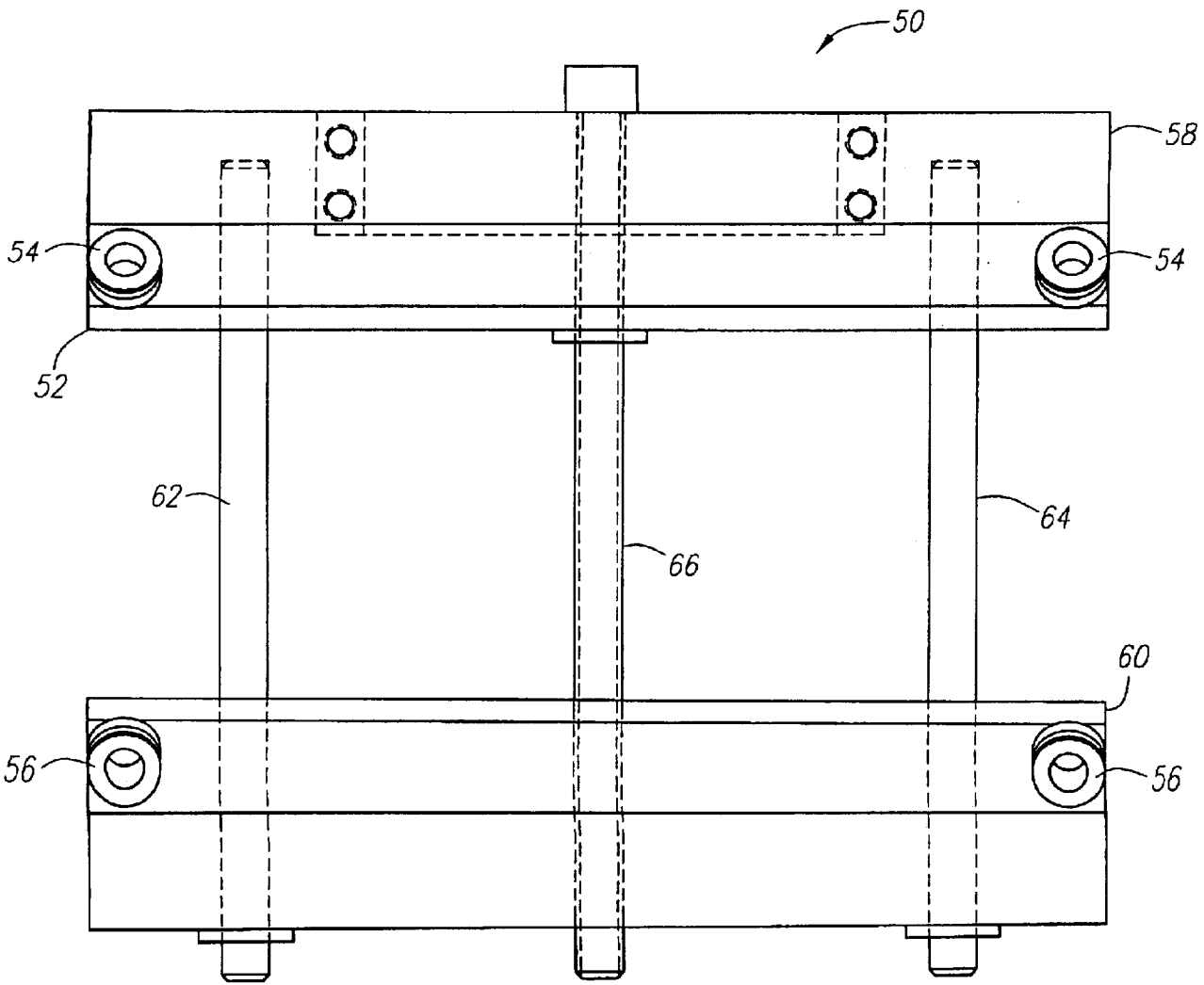
FIG. 6 is a front view of a tool for installation of the elongate retainer.
Figure 7:
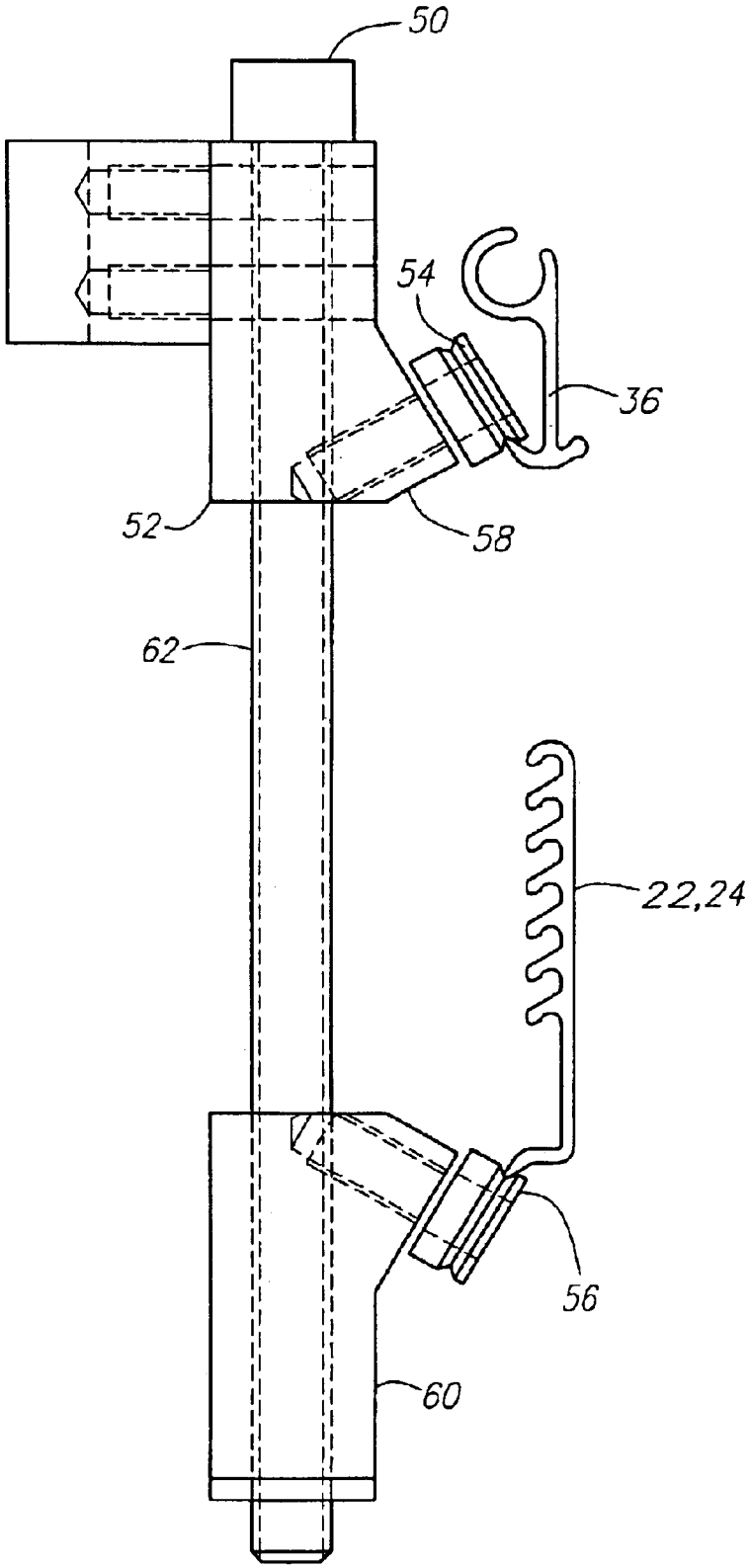
FIG. 7 is an end view of the tool of FIG. 6.

From FIG. 2 it can be observed that the elongate frame rail surface 34 on the frame 22, 24 is facing away from the retainer rail surface 46 on the retainer 36. These most adjacent rail surfaces 34 and 46 accommodate a tool. A first tool 50 is illustrated in FIGS. 6 and 7. The tool 50 includes a frame 52 rotatably supporting two sets of rollers. Each set includes two rollers 54 and 56. The rollers 54 and 56 in each set define a pinch therebetween. The frame 52 mounts the rollers 54 on a first holder 58 and mounts the rollers 56 on a second holder 60. The holders 58 and 60 include parallel guide dowels 62 and 64 and a parallel adjustment screw 66 used to move the rollers 54 and 56 to adjust the pinch. The rollers 54 and 56 are shown to be at an angle to one another. This allows them to ride on the tips of the rail surfaces 34 and 46. The rollers 54 and 56 include grooves to receive these tips.

The two pinch rollers 54 and 56 are mutually displaced at the pinch to accommodate the size of the sheet 14. The frame 52 is adjustable to place the sheet 14 in tension when the tool 50 has the rail surfaces 34 and 46 within the pinch of the rollers 54 and 56. A slight over tension is appropriate to that which will be the final state of the sheet 14 in order that the tool 50 may place the elongate flange 40 in the slots between the ribs 28. As the tool 50 moves forward with the flange 40 progressively located in one of the slots between the ribs 28, the tension from the tool 50 is released and the engagement surface 30 and interlocking surface 42 come into interlocking engagement.

Figure 9:
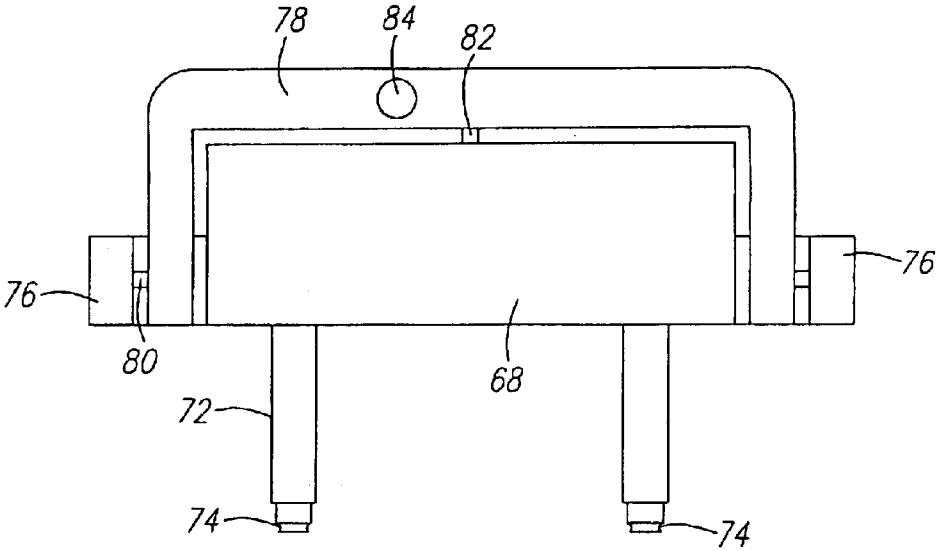
FIG. 9 is a plan view of the tool of FIG. 8.
Figure 10:
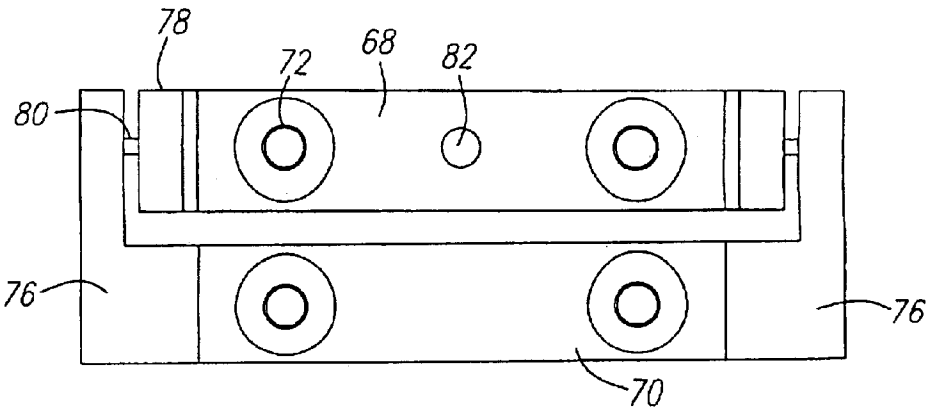
FIG. 10 is a front view of the tool of FIG. 8.
Figure 8:
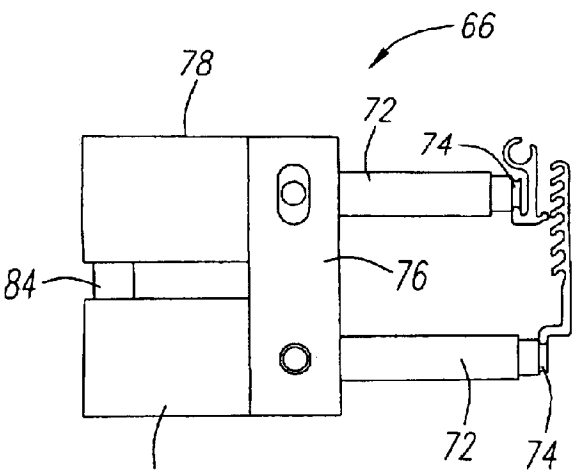
FIG. 8 is an end view of a second tool for installation of the elongate retainer.

A second tool 66 is illustrated in FIGS. 8, 9 and 10. This tool 66 includes an upper block 68 and a lower block 70 which each rotatably mount shafts 72 in bearings. The shafts include pinch roller surfaces 74. The pinch roller surfaces 74 are in pairs to create two areas of pinch for compressing the rails together as illustrated in FIG. 8. To adjustably mount the two blocks 68 and 70 together, end caps 76 are fixed to either end of the lower block 70. These end caps 76 extend upwardly to pivotally receive a U-shape bracket 78, as best seen in the plan view of FIG. 9. The bracket 78 is able to pivot to a small degree about the pivots 80 at either end. A pivot 82 is centrally mounted in the bracket 78 and pivotally mounts the upper block 68. Thus, the upper block can pivot in such a way the the pinch roller surfaces can alternately close and open to accommodate variations in the rails. Further, the upper block 70 can pivot relative to the lower block 68 to tighten or loosen the pinch. To control this movement, a set screw 84 extends from the U-shaped bracket 78 to the lower block 70. Tightening of the set screw 84 draws the pinch roller surfaces together.

In operation, a prepared sheet is finished by threading the tenon element 20 into the mortise element 48 of the elongate retainers 36 about the four peripheral sides of the sheet 14. The retainers 36 on the top and one side of the sheet 14 are then located in an appropriate slot between the ribs 28 on the appropriate frames 22 and 24. The tool 50 or 66 is then placed over the rails 32 and 44 on the lower frame member 22. The elongate flange 40 is then located within a slot between two ribs 28 and drawn progressively the length of the lower frame member 22. The same operation is then performed on the free end with the frame member 24. The sheet can be taken off in the same manner by compressing the rails 32 and 34 toward each other within the pinch of the tool 50 while the retainer 36 is pulled away from the associated frame member 22, 24.

Thus, an improved mounting system is disclosed for large sheet material. While embodiments and applications of this invention have been shown and described, it would be apparent to those skilled in the art that many more modifications are possible without departing from the inventive concepts herein. The invention, therefore is not to be restricted except in the spirit of the appended claims.

What is claimed is:

1. A mounting for a sheet having a periphery defining at least two opposed edges, comprising a first elongate frame member;

a second elongate frame member displaced from the first elongate frame member engageable with one of the opposed edges of the sheet, the first elongate frame member including a continuous frame rail extending continuously substantially the length of the first elongate frame member and facing away from the second elongate frame member; and an elongate retainer associated with the first elongate frame member, and including an elongate retainer element to engage the sheet along the other of the two opposed edges and a continuous retainer rail facing away from the frame rail and extending continuously substantially the length of the frame rail, one of the first elongate frame member and the elongate retainer further including engagement surfaces facing away from the second elongate frame member and the other of the first elongate frame member and the elongate retainer further including an interlocking surface positionable in interlocking engagement with any one of the engagement surfaces, the interlocking surface being movable laterally of the engagement surfaces to be positioned in interlocking engagement with any one of the engagement surfaces, there being an unequal number of the engagement surface and the interlocking surfaces for tension adjustment of the sheet.

2. The mounting of claim 1 further comprising parallel elongate ribs defining the mutually parallel multiple engagement surfaces, respectively, the ribs being angled away from the second elongate frame member.

3. The mounting of claim 2 further comprising an elongate flange, the interlocking surface being on the elongate flange.

4. A combination comprising the mounting of claim 1; and the sheet held by the second elongate frame member along the first of the two opposed edges and held by the elongate retainer element positionable in interlocking engagement with the first elongate frame member along the second of the two opposed edges.

5. The combination of claim 4 comprising a truck, the first elongate frame member and the second elongate frame member being attached to the truck.

6. The combination of claim 4, the sheet including a sheet tenon and mortise element and the elongate retainer element including a retainer tenon and mortise element to engage the sheet.

7. The combination of claim 4 further comprising a tool including at least two pinch rollers defining a pinch, the pinch being adjustable and engageable with the frame rail and the retainer rail surfaces of a respective elongate frame member and its associated elongate retainer.

8. The combination of claim 7, the pinch being adjustable.

9. The combination of claim 8, the pinch including at least one roller.

10. The combination of claim 9, the pinch including at least two rollers.

* * * * *